United States Patent [19]

Almqvist et al.

[11] Patent Number: 4,646,821

[45] Date of Patent: Mar. 3, 1987

[54] PLATE ELEMENTS AND GASKETS AT PLATE HEAT EXCHANGERS OR PLATE FILTERS

[75] Inventors: Christer Almqvist, Täby; Lars Lindahl, Handen, both of Sweden

[73] Assignee: ReHeat AB, Taby, Sweden

[21] Appl. No.: 680,043

[22] Filed: Dec. 10, 1984

[30] Foreign Application Priority Data

Jan. 24, 1984 [SE] Sweden ..... 8400349

[51] Int. Cl.[4] ..... F28F 3/00

[52] U.S. Cl. ..... 165/166; 165/167

[58] Field of Search ..... 165/166, 167

[56] References Cited

U.S. PATENT DOCUMENTS 4,219,079 8/1980 Sumitomo ..... 165/167 X 4,253,520 3/1981 Friedericy et al. ..... 165/166

FOREIGN PATENT DOCUMENTS 500339 2/1939 United Kingdom ..... 165/166

502819 3/1939 United Kingdom ..... 165/166

2117890 10/1983 United Kingdom ..... 165/166

*Primary Examiner*—Albert W. Davis, Jr.

*Assistant Examiner*—Peggy A. Neils

*Attorney, Agent, or Firm*—Cushman, Darby & Cushman

[57] ABSTRACT

A gasket groove at plate elements of plate heat exchangers, characterized in that a first gasket groove of a plate element (1; 2), as seen in cross section, extends between the limiting planes of the element and has an elevation (3) arranged in the bottom of the groove, which elevation forms a cavity on the other side of the groove and consequently also the element, which cavity forms a second gasket groove cooperating with a corresponding cavity (3) of an adjacent, reversed first gasket groove of a second plate element (2; 1).

4 Claims, 5 Drawing Figures

PLATE ELEMENTS AND GASKETS AT PLATE HEAT EXCHANGERS OR PLATE FILTERS

This invention relates to the fixation of plate elements against reciprocal displacement at plate heat exchangers or plate filters.

Previously only the supporting axles or beams in heat exchanger frames or filter stands have served as fixations and guides of plate elements in a plate heat exchanger or a plate filter. The plate elements are provided with gaskets running in gasket grooves, which control the medium flow and seal the channels between the plate elements. In order to obtain sealing the gaskets are compressed by the plate elements being clamped between two end sections of the frame. As a rule the material of the gaskets is elastomeric. Elastomeric gaskets are compressed between 20 and 40% to obtain a gasket pressure for good sealing. When clamping the plate elements for compression of the gaskets the plate elements are moved along the supporting beams and the gasket pressures are high, the forces also being great especially at the end of the contraction of the plate elements. These forces on the plate assembly between the end sections may also give rise to relatively great lateral forces on individual plate elements which at bad fixation of the plate elements in the supporting beams may cause the plate elements to slide aside relative to each other, so that the gaskets and sealing surfaces of the plate elements no longer bear against other, leakage arising. This tendency to sliding is increased by the fact that the sealing surface of the plate elements is coated with a release agent, e.g. silicon oil, in order to prevent the gaskets from sticking to adjacent plate element and consequently coming loose when the plate heat exchanger or the plate filter is opened e.g. for cleaning.

A solution for fixing the plate elements to each other so that they do not slide is to provide the plate elements reciprocally with fixing means. However, the space on the plate elements for placing such fixing means without influencing the function of the plate element is strongly restricted. According to a later solution the gasket grooves of the plate elements are placed on an intermediate plane so that the gaskets laterally bear against the distance members of adjacent plate element. In this way the need of special fixing means is eliminated and fixation between the plate elements is obtained with a very large number of points on the plate elements with the gaskets as guide bars, and the previous sealing functions of the gaskets, the gasket grooves and the sealing surface remain unchanged. However, this latter solution requires that the bottom plane of the gasket groove must be disposed about in the neutral plane of the plate element.

A common problem with the above-mentioned types of gaskets is that the sealing between the plate elements is achieved merely by means of the previously mentioned compression force at the clamping of the plates. The plates may easily "blow out" at elevated pressure or pressure thrusts. By the present invention, such as it appears from the characterizing portions of the claims, it is possible to eliminate said problems and the pressure between the plates will contribute positively to the sealing between the plates.

IN THE DRAWINGS

Figure 1:
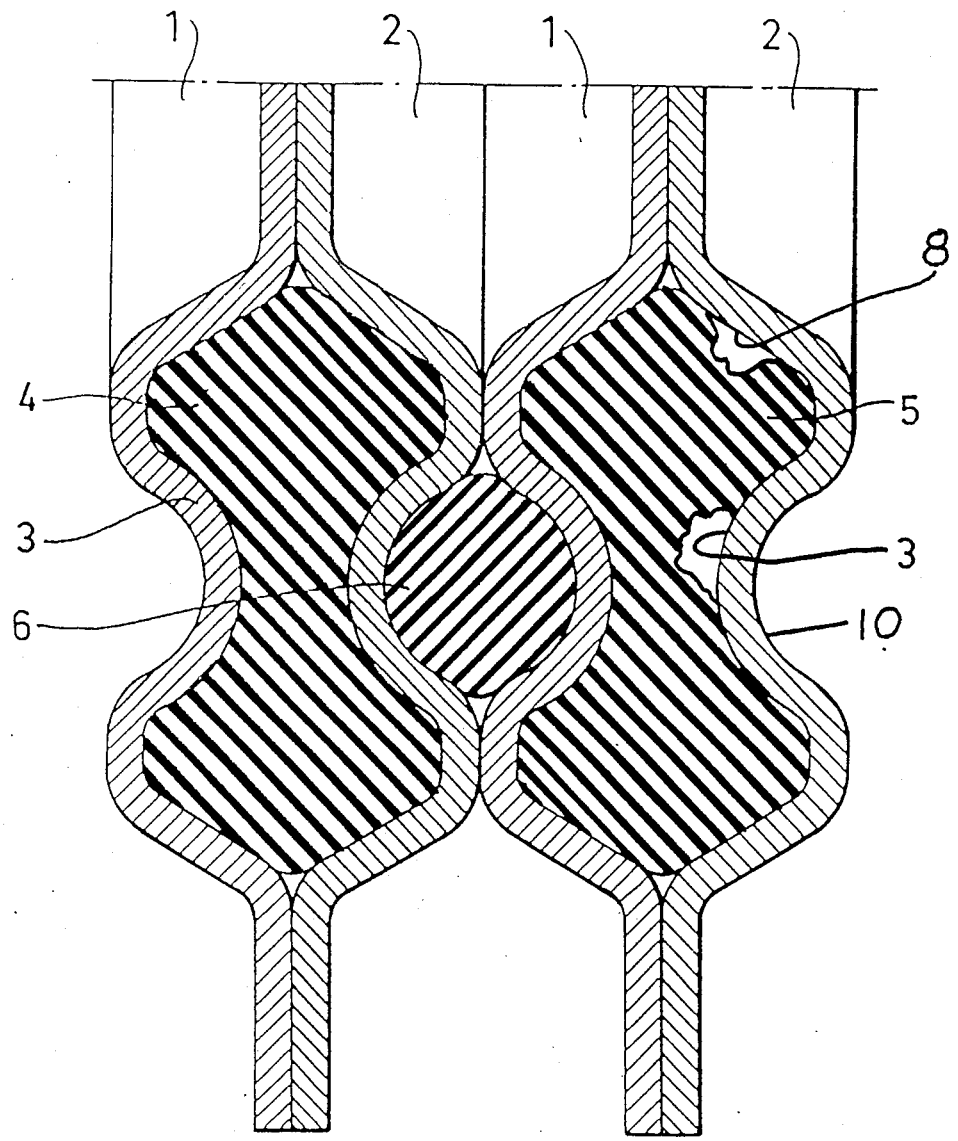
FIG. 1 is a sectional view through four plate elements of a heat exchanger.
Figure 3:
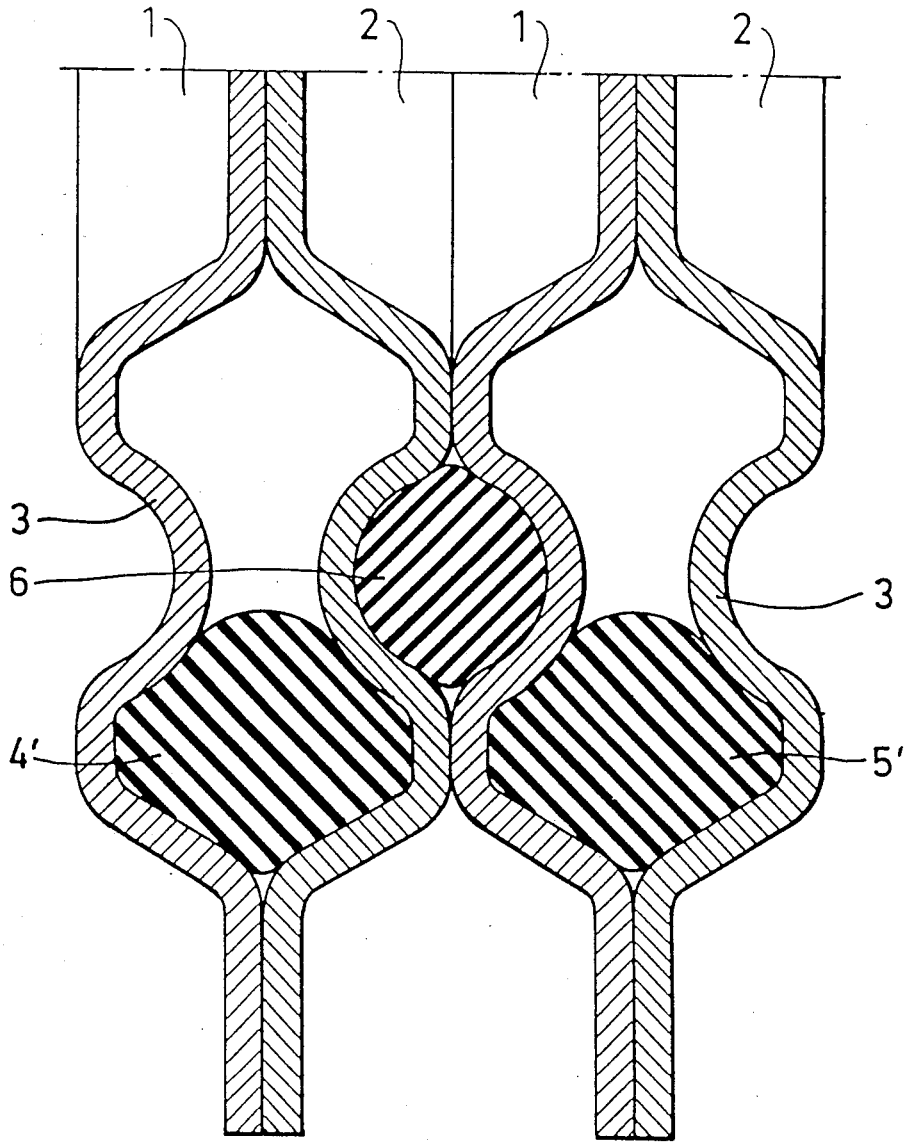
FIG. 3 is a view similar to FIG. 1 illustrating a second embodiment.

1 and 2 designate plate elements reversed relative to each other. In FIGS. 1 and 3 only a part section of the portion of the peripheral gaskets of four plate elements is shown. It is e.g. evident from FIG. 1 that in each plate a groove 8 is provided with a partially circular elevation 3 arranged in the bottom of the groove 8. As seen from the other side of the gasket groove this elevation forms a longitudinal cavity 10 which is partially circular. Moreover, as is evident from FIG. 1 and as is mentioned the plate elements are reversed as regards the gasket grooves and in this way every other gasket groove will be substantially circular and every other will have an I- or H-form as seen schematically in section. In such a gasket groove formed by the two plate elements 1 and 2 a gasket of a form substantially corresponding to the gasket groove, i.e. schematically seen of an I- or H-form, is arranged, while an adjacent gasket due to the form of the cavities preferably has a circular cross section.

Figures 2A, 2B, 2C:
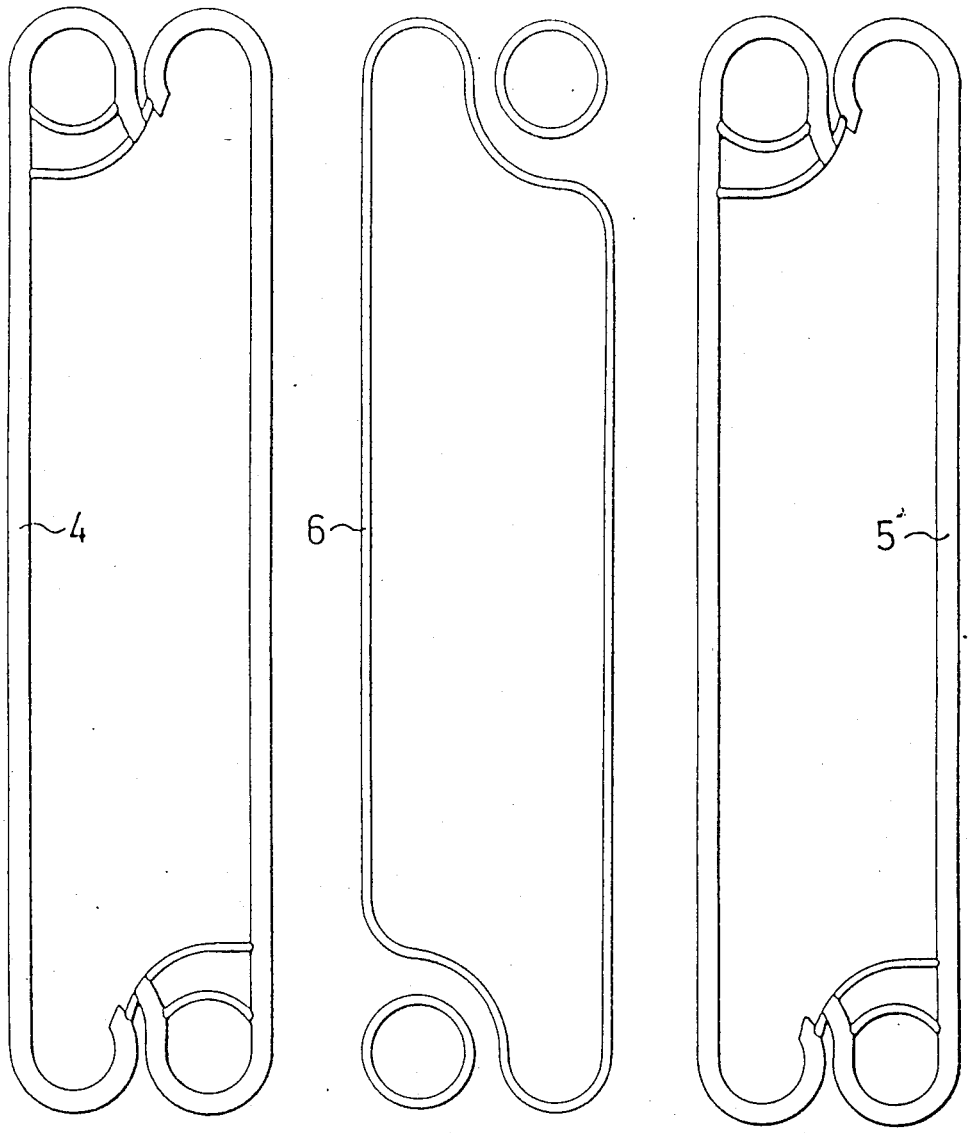
FIGS. 2A and 2B are plan views of the I-shaped gaskets of FIG. 1.
FIG. 2C is a plan view of the circular gasket of FIG. 1.

In FIG. 2 those gaskets of the plate elements of a plate heat exchanger are schematically shown, which are shown in section in FIG. 1. The very extension of the relative gasket does not mean anything new per se but is of a current form, the inlets and outlets of the relative element clearly appearing from the FIG.

When mounting the plate heat exchanger the plate elements are clamped in conventional manner between the end sections of the frame, but in view of the new gaskets according to the invention the same high pressure is not required as has so far been necessary, in order to obtain a perfectly satisfactory sealing between the individual plate elements. At a liquid pressure between two plate elements 1 and 2 the hydrostatic pressure will tend to press the gasket outwards and then press this sealingly against the two outer portions bearing against each other of the plate elements. As is easily realized this applies both to the I-shaped gasket 4 and 5 as well as the circular gasket 6. At the same time as the press pressure can be lowered which means that the stress on the relative gasket is reduced and, consequently, the life of the gasket is increased the gaskets will automatically reciprocally guide the plate elements in a plate assembly, i.e. the "flanges" of the I-shaped gasket 4 and 5 guide the plate elements 1 and 2 relative to each other and the gasket 6 substantially circular in cross section guides the plate elements 2 and 1 relative to each other.

In FIG. 3 a modified embodiment of the gaskets 4 and 5 is shown. These gaskets 4' and 5' can be said to consist of merely "one flange" of the I-shaped gasket, as previously described, but this gasket 4', 5' will of course serve the same purpose as the previously mentioned gasket 4, 5.

Of course it is possible within the scope of the invention to vary the form of the gasket grooves. The main thing is that a sealing effect is obtained which increases with the hydrostatic pressure between the plate elements, at the same time as these are guided in an efficient way relative to each other in the mounted plate assembly.

What we claim is:

1. In a plate heat exchanger having a plurality of stacked heat exchange plates of the same configuration, each having a groove in one surface thereof, said groove forming a protrusion on the opposite surface of said plate, the bottom of said groove, viewed from said one surface, having an elevation located between the walls of said groove and extending longitudinally along said groove, said elevation forming on said opposite surface of the plate a cavity extending longitudinally along said protrusion, adjacent plates being reversed so that the groove in a given plate faces the corresponding groove in a second plate adjacent said one surface of said given plate to form a first gasket groove between the given plate and the second plate and so that the cavity in said given plate faces the cavity in a third plate adjacent said opposite surface of said given plate to form a second gasket groove between the given plate and the third plate.

2. A plate heat exchanger as in claim 1 wherein the second gasket groove has a partially circular profile to receive a gasket of a substantially circular profile.

3. A plate heat exchanger as in claim 1 wherein the first gasket groove of an element, in cooperation with the first gasket groove in an adjacent element, has a substantially H-shaped profile to receive a gasket of a substantially H-shaped profile.

4. A plate heat exchanger as in claim 1 wherein the first gasket groove of an element, in cooperation with the first gasket groove in an adjacent element, has a substantially H-shaped profile to receive a gasket only in one pile portion of the profile.

* * * * *